US006944972B2

(12) United States Patent
Schmid

(10) Patent No.: US 6,944,972 B2
(45) Date of Patent: Sep. 20, 2005

(54) ENERGY RETURN SOLE FOR FOOTWEAR

(76) Inventor: Rainer K. Schmid, 2050 Garden Ave., Eugene, OR (US) 97403

( * ) Notice: Subject to any disclaimer, the term of this patent is extended or adjusted under 35 U.S.C. 154(b) by 25 days.

(21) Appl. No.: 10/681,536

(22) Filed: Oct. 7, 2003

(65) Prior Publication Data

US 2004/0107601 A1 Jun. 10, 2004

Related U.S. Application Data

(63) Continuation-in-part of application No. 09/827,933, filed on Apr. 9, 2001, now Pat. No. 6,860,034.

(51) Int. Cl.[7] ..... A43B 13/28
(52) U.S. Cl. ..... 36/27; 36/35 R; 36/7.8
(58) Field of Search ..... 36/27, 28, 38, 36/7.8, 35 R, 99, 71

(56) References Cited

U.S. PATENT DOCUMENTS

| | | | |
|---|---|---|---|
| 75,900 | A | 3/1868 | Hale et al. |
| 324,065 | A | 8/1885 | Andrews |
| 413,693 | A | 10/1889 | Walker |
| 493,663 | A | 3/1893 | Steuart |
| 1,144,188 | A | 6/1915 | Gerlach |
| 1,236,924 | A | 8/1917 | Golden |
| 1,516,395 | A | 11/1924 | Miceli |
| 2,228,149 | A | 1/1941 | Maccarone |
| 3,739,500 | A | 6/1973 | Cox |
| 3,822,490 | A | 7/1974 | Murawski |
| D247,074 | S | 1/1978 | Henry |
| 4,223,458 | A | 9/1980 | Kihara |
| 4,231,169 | A | 11/1980 | Toyama et al. |
| 4,279,415 | A | 7/1981 | Katz |
| 4,317,293 | A | 3/1982 | Sigle et al. |
| 4,457,084 | A | 7/1984 | Horibata et al. |
| 4,486,964 | A | 12/1984 | Rudy |
| 4,541,184 | A | 9/1985 | Leighton |
| 4,592,153 | A | 6/1986 | Jacinto |
| 4,597,196 | A | 7/1986 | Brown |
| 4,611,413 | A | 9/1986 | Brown |
| 4,628,621 | A | 12/1986 | Brown |
| 4,631,841 | A | 12/1986 | Hickey |
| 4,642,911 | A | 2/1987 | Talarico, II |
| 4,651,445 | A | 3/1987 | Hannibal |
| 4,858,338 | A | 8/1989 | Schmid |
| 4,910,884 | A | 3/1990 | Lindh et al. |
| 5,060,401 | A | 10/1991 | Whatley |
| 5,203,095 | A | 4/1993 | Allen |
| 5,282,325 | A | 2/1994 | Beyl |
| 5,337,492 | A | 8/1994 | Anderie et al. |
| 5,343,636 | A | 9/1994 | Sabol |
| 5,343,637 | A | 9/1994 | Schindler |
| 5,353,523 | A | 10/1994 | Kilgore et al. |
| 5,435,079 | A | 7/1995 | Gallegos |
| 5,678,327 | A | 10/1997 | Halberstadt |
| 6,029,374 | A | 2/2000 | Herr et al. |
| 6,860,034 | B2 * | 3/2005 | Schmid ..... 36/27 |

FOREIGN PATENT DOCUMENTS

| | | |
|---|---|---|
| DE | 620963 | 10/1935 |

* cited by examiner

*Primary Examiner*—Jila M. Mohandesi
(74) *Attorney, Agent, or Firm*—Burns Doane Swecker & Mathis LLP

(57) ABSTRACT

An article of footwear having an upper, an outsole defining a ground engaging surface, and a sole disposed between the upper and the outsole. The sole includes an energy return system having a first rigid plate, a second rigid plate spaced a predetermined distance from the first rigid plate, and at least one separating element disposed therebetween to maintain the spacing between the plates.

18 Claims, 8 Drawing Sheets

ENERGY RETURN SOLE FOR FOOTWEAR

CROSS-REFERENCE TO RELATED APPLICATIONS

This application is a continuation-in-part of U.S. patent application Ser. No. 09/827,933 filed on Apr. 9, 2001 now U.S. Pat. No. 6,860,034, which is incorporated herein by reference in its entirety.

BACKGROUND OF THE INVENTION

1. Field of the Invention

The present invention relates to an improved sole for footwear and more particularly to a sole which absorbs, stores and returns kinetic energy to a wearer of the footwear during the gait cycle.

2. Summary of the Related Art

Recently, considerable efforts have been devoted to develop improved running and other athletic shoes. Currently, there are many different types of running or athletic shoes which purport to provide cushioning from impact and comfort for all phases of activity. Shock absorption has been the primary focus of most of these research efforts. For example, U.S. Pat. No. 4,541,184 (Leighton) discloses an insole which is designed to provide shock absorption in the areas of the foot that are most subject to impact forces from ground contact.

Recent advances in biomechanics, however, indicate that cushioned running shoes may decrease the efficiency of the user. Experimenters have found that the arch of the foot acts like a spring, absorbing the energy of impact with the ground and giving it back with surprising efficiency to launch a runner forward again. Cushioned shoes, however, act to absorb the kinetic energy for the athlete. Up to 67% of the kinetic energy of a gait cycle may be absorbed and wasted by conventional athletic shoes.

The problem which must be addressed is not only how to minimize impact and provide comfort for the athlete's foot in running, jumping and other athletic endeavors, but also how to harvest and utilize energy resulting from certain phases of walking or running such as heel strike, midstance and toe off.

Some efforts have been devoted to develop devices which absorb and return a portion of the energy of the impact between a runner's foot and the ground. For example, U.S. Pat. No. 4,628,621 (Brown) discloses a rigid orthotic insert made of a plurality of layers of graphite fibers. The insert includes a mid-arch portion which is slightly raised relative to the rear portion and the forward portion of the insert. The insert however is disposed above the sole on the shoe. As discussed above, up to 67% of the gait cycle may be absorbed by cushioned soles. Therefore, most of the kinetic energy of the wearer is absorbed before reaching the orthotic insert.

U.S. Pat. No. 4,486,964 (Rudy) discloses a pair of moderators made of spring-type material which absorb and return kinetic energy. A first moderator is disposed in the heel area and absorbs high shock forces at heel strike. This moderator, which is shaped to cup and center the calcaneus at heel strike, elastically deforms and absorbs the energy at heel strike. As the athlete's gait cycle continues and the force on the moderator is reduced it returns the energy to the athlete. The second moderator disclosed by Rudy engages the forefoot of the athlete and has similar properties.

U.S. Pat. No. 5,353,523 (Kilgore et al.) has also addressed the issue of energy return. Kilgore et al. provide upper and lower plates which are separated by one or more foam columns. The foam columns, or support elements, are formed as hollow cylinders from a microcellular polyurethane elastomer whereas the upper and lower plates are formed from a semi-rigid material such as nylon, a polyester elastomer, or nylon having glass mixed therethrough. Further, within the hollow areas of the support elements are gas pressurized bladders. Kilgore et al. relies upon the use of microcellular polyurethanes to restore the energy imparted during impact and upon the two element cushioning component to provide proper cushioning to the wearer.

The devices of Rudy, Brown and Kilgore et al. do not return the impact energy to the runner during the entire gait cycle due in part to the presence of the elastomeric material forming the midsole of the shoe wich absorbs the energy.

The gait cycle typically consists of heel strike, midstance, a forward roll of the foot to the ball of the foot (toe break), and toe off. At the start of the walking gait cycle the initial part of the foot to engage the ground is the outward portion of the heel. This phase of the gait cycle is referred to as heel strike. Next the foot rolls to midstance and then rolls forward to the ball of the foot. In the final phase, referred to here as toe off, the toes propel the foot off the ground. The large toe provides the majority of the propelling thrust during this phase. It may provide up to 70% of the total thrust with the four small toes providing the balance.

The running gait cycle differs from the walking gait cycle in that the initial part of the foot to engage the ground is the outward portion of the arch rather than the heel. Ground reaction forces and the line of progression of ground reaction forces on a runner's foot have been studied by Cavanagh et al., "Ground Reaction Forces in Distance Running", 13 J. Biomechanics 397 (1980). It would be advantageous to provide a device which utilizes the impact forces developed along the lines of progression of forces along the foot to optimally return the kinetic energy of the wearer's foot back to the wearer throughout the gait cycle during walking and/or running.

Shoe mechanics studies also provide other desirable features which advantageously use the mechanics of the gait cycle. For instance Perry et al., "Rocker Shoe as Walking Aid in Multiple Sclerosis", 62 Arch Phys. Med. Rehabil. 59 (1981), demonstrates that clogs with a rocker bottom significantly facilitate ambulation of patients with certain neurologic deficits. The study suggests that a mean savings of 150% of normal energy was gained by multiple sclerosis patients which used a shoe having a rocker bottom sole.

Another factor which must be accounted for is the 25° external torsion of the foot and ankle relative to the knee axis in a gait cycle. That is, at toe off the foot twists outward, at an average angle of 25°, as the knee and hip extend forward.

It would be advantageous to provide a shoe which utilizes the rocker bottom principle along with the biomechanics of the gait cycle to improve the efficiency of an athlete. Such a shoe could harvest and utilize the energy resulting from certain phases of walking or running, store up the energy and return the energy to the athlete, thereby improving the efficiency of the athlete.

SUMMARY OF THE INVENTION

In view of the drawbacks of the prior art, it is the purpose of the present invention to provide a shoe sole for an article of footwear which will store the energy during the gait cycle and return the energy to the wearer.

To accomplish this purpose there is provided an article of footwear comprising a first rigid energy return plate, a second rigid energy return plate independent from the first rigid plate and spaced a predetermined distance from the first rigid plate, a first elastomeric separating element connecting the first and second plates forward of an area of the footwear corresponding to the ball of the foot, a second elastomeric separating element connecting the first and second plates behind the area corresponding to the ball of the foot and forward of an area corresponding to the heel, said first and second plates deflecting when loaded during a phase of gait cycle, storing energy and returning to a non-deflected state, releasing energy, propelling a wearer at a subsequent phase of the gait cycle.

In another aspect of the invention there is provided an article of footwear comprising a first energy return plate formed of a rigid material having a modulus of elasticity of about $10\times10^6$ psi to about $100\times10^6$ psi, a second energy return plate independent from the first rigid plate, the second energy return plate formed of a rigid material having a modulus of elasticity of about $12\times10^6$ psi to about $100\times10^6$ psi, and first and second elastomeric separating elements connecting the first and second plates, the elastomeric separating elements having a tensile strength of about 2000 to about 6000 psi, and wherein the first and second elastomeric separating elements are positioned to form a void between the first and second plates and the first and second elastomeric separating elements allowing the first and second plates to move with respect to one another in a plurality of dimensions.

In yet another aspect of the invention there is provided an article of footwear comprising a first rigid energy return plate extending from a toe area of the foot and terminating at an arch area of the foot, a second rigid energy return plate independent from the first rigid plate and spaced a predetermined distance from the first rigid plate, the second rigid energy return plate extending from the toe area of the foot and terminating at the arch area of the foot, a first elastomeric separating element connecting the first and second plates forward of an area of the footwear corresponding to the ball of the foot, and a second elastomeric separating element connecting the first and second plates behind the area corresponding to the ball of the foot and forward of an area corresponding to the heel, said first and second plates deflecting when loaded during a phase of gait cycle, storing energy and returning to a non-deflected state, releasing energy, propelling a wearer at a subsequent phase of the gait cycle.

BRIEF DESCRIPTION OF THE DRAWINGS

The invention will now be described in greater detail with reference to the preferred embodiments illustrated in the accompanying drawings, in which like elements bear like reference numerals, and wherein.

DETAILED DESCRIPTION OF THE PREFERRED EMBODIMENTS

Figure 1:
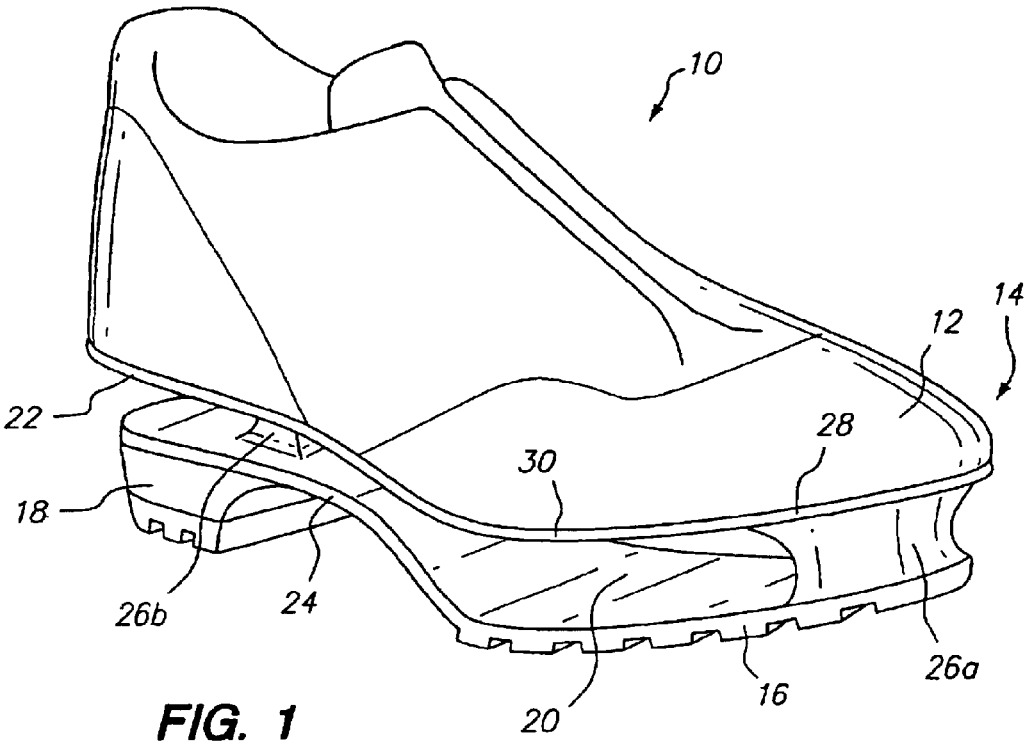
FIG. 1 is a perspective view of a shoe including the energy return system of the present invention.
Figure 2:
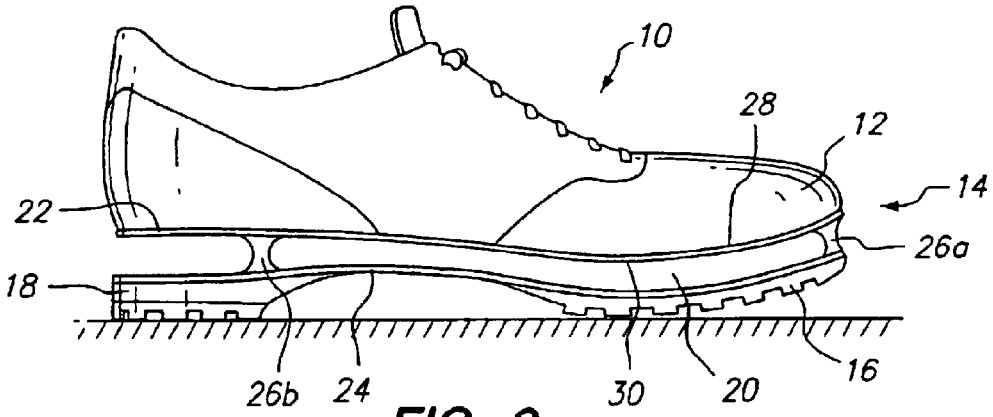
FIG. 2 is a lateral view thereof.
Figure 3A:
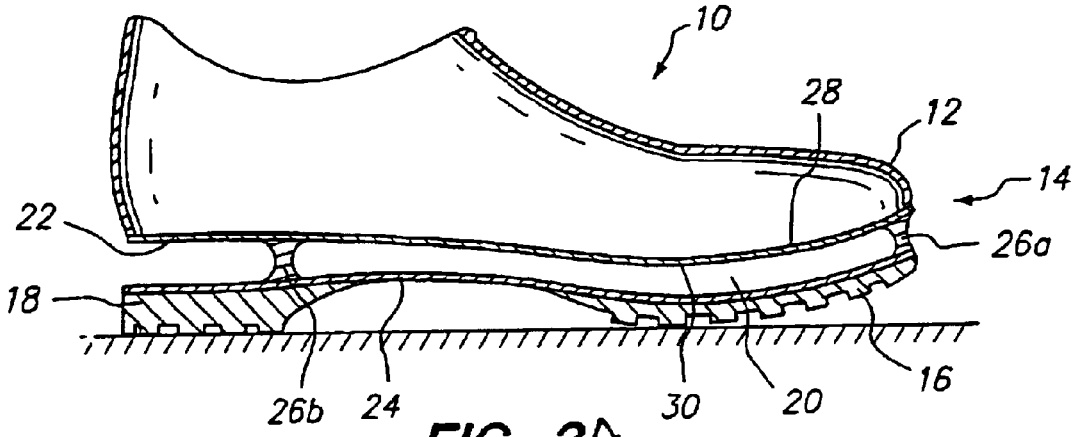
FIG. 3A is a cross-sectional view thereof.
Figure 3B:
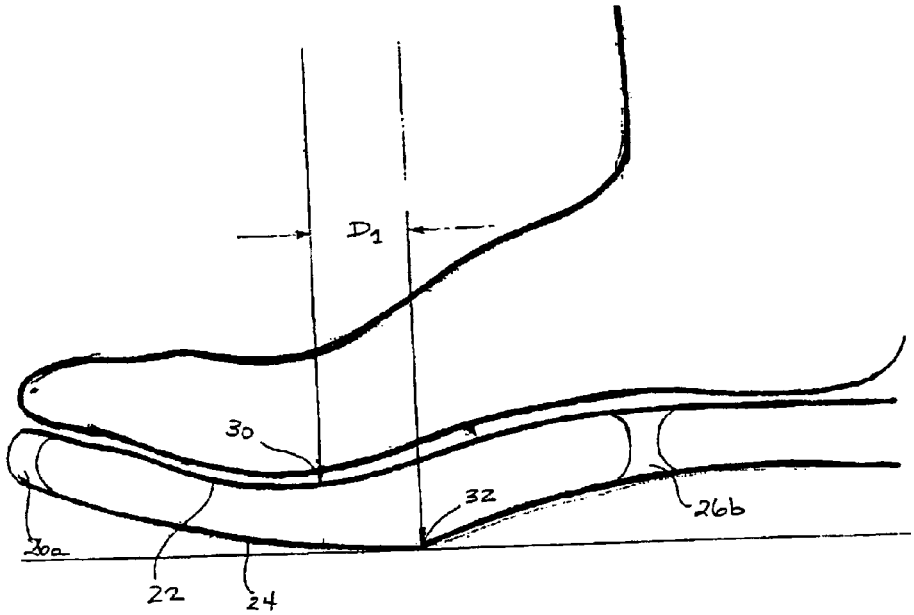
FIG. 3B is a cross-sectional side view of a portion of FIG. 3A shown schematically supporting a foot.

Referring to FIGS. 1–3 a shoe 10, which is preferably an athletic shoe includes an upper portion 12 and a sole portion, designated generally by reference numeral 14. The sole portion 14 includes an outsole 16 and an energy return system 20, and may further include a heel 18 as shown in the illustrated embodiment. The energy return system 20 is defined by a proximal or upper sole plate 22, a distal or lower sole plate 24 and at least one separating element 26.

The outsole 16 defines the ground engaging surface and is preferably designed with conventional sole treads for providing traction to the wearer. The outsole is preferably formed from a conventional wear-resistant material, such as a carbon-black rubber compound. The heel 18, if provided, is preferably disposed immediately above the portion of the outsole 16 disposed on the posterior end of the shoe 10 and is formed preferably from a conventional cushioning material such as ethyl vinyl acetate (EVA) or polyurethane (PU) foam. The heel 18 is thus made of conventional shock absorbing material which acts to absorb the shock from ground force contact.

The energy return system 20 is preferably disposed between the outsole 16 and the upper portion 14 and, in the illustrated embodiment of FIG. 1, extends approximately the entire length of the shoe.

The energy return system 20 includes upper and lower sole plates 22, 24, which, in an exemplary embodiment, are fabricated from rigid, light weight, high strength materials. Suitable materials include fiber reinforced materials, such as carbon and boron based fibrous materials; reinforced or unreinforced thermoplastic and thermosetting polymers; metals and metal alloys; and composites thereof. The metals may include aluminum, titanium, and alloys thereof. The polymers may be amorphous, glassy, or crystalline.

Thermoplastic polymers include, but are not limited to, polyethylene, polyvinyl chloride (PVC), polypropylene, the styrene based polymers acrylonitrile-butadiene-styrene (ABS) and polystyrene, polycarbonate, polyethylene terephthalate (PET), polyesters, polyamide (nylon), polyvinylidene chloride, polyacrylonitrile, polymethyl methacrylate (acrylic, PMMA), polyoxymethylene (acetal), polytetrafluoroethylene (teflon), polyethersulfone, polyetherimide, and polyamide-imide. Exemplary thermosetting polymers include the epoxies, phenolics (condensation products of phenol and formaldehyde), amino resins (such as urea-formaldehyde or malamine-formaldehyde), polyimides (cross-linked and/or glass filled).

The thermoplastic resins described above have a tensile strength generally ranging from about 2 to $20\times10^3$ psi, an elastic modulus ranging from about 0.1 to $0.8\times10^6$ psi, and an elongation ranging from about 1 to 300 percent. Similar properties for the thermosetting resins are 3 to $15\times10^3$ psi, 0.3 to $1.6\times10^6$ psi, and 0 to 6 percent, respectively.

Of course, the above-described polymers may serve as a matrix material for a composite structure, wherein the matrix polymer is reinforced with a second phase material generally in fiber form. Exemplary fiber materials include glass, carbon (typically in graphite form), aramid (Kevlar), boron, and silicon carbide. The elastic moduli of the fiber materials glass, carbon, and Kevlar are from about $10\times10^6$, 30 to $50\times10^6$, and $20\times10^6$ psi, respectively. The elastic moduli of the matrix polymers epoxy and polyester range from about 0.1 to $0.5\times10^6$ psi. Exemplary composites may include fiberglass, in which glass fibers are used to reinforce matrix polymers such as polyester or nylon, or carbon (specifically graphite) fibers used to reinforce, for example, an epoxy resin. Such composites may include carbon in epoxy, glass in polyester, and Kevlar in epoxy, resulting in reinforced materials with elastic moduli ranging from about 10 to about $35\times10^6$ psi.

According to one embodiment, the plates 22, 24 are fabricated from a rigid material or composite having an elastic moduli of about $1.0\times10^6$ to about $100\times10^6$ psi. When polymers having moduli of elasticity of less than $1.0\times10^6$ psi are used these materials can be reinforced with suitable fibers to achieve a desired rigidity.

According to another embodiment, the plates 22, 24 are fabricated from a rigid material or composite having an elastic moduli of about $10\times10^6$ to about $100\times10^6$ psi to achieve a high degree of energy return. The material and thickness of the plates can be varied to achieve a desired energy return and to accommodate persons of different sizes.

In an exemplary embodiment, the plates 22, 24 are fabricated solely from graphite fibers. Graphite has the advantages of having a high tensile strength, a modulus of elasticity of about $33\times10^6$ psi, a density of about 1.8 $Mg/m^3$, and the ability to be easily processed. The upper and lower sole plates 22, 24 may comprise either a single layer of graphite fibers, or a plurality of layers 23.

The sole plates 22, 24 may be formed generally in accordance with the teachings of U.S. Pat. No. 4,858,338 to Schmid, the entire contents of which are hereby incorporated by reference, wherein crossed fibers of a straight graphite strip and an angled graphite strip are used to cradle the first metatarsal head of the foot, provide maximum stiffness to resist torsion in both directions and activate the rocker bottom system, as discussed below. In the particular embodiment illustrated, however, a heel 18 having a greater height is provided. Further, in a preferred embodiment of the present invention, the graphite fibers will extend to the end of the shape of the plates 22, 24 and the fibers will be disposed in three different directions. There are preferably approximately twenty layers 23 of graphite fibers in the plates 22, 24 of the present invention, each layer providing increased shock absorption and energy release along the path of the gait cycle, as described in greater detail below.

The upper graphite plate 22 is formed such that a rocker bottom, indicated generally by reference numeral 28, cradles the first metatarsal head of the foot of the wearer. The width of the plate 22 is adapted to cover at least the width of the user's large toe and first metatarsal head, but may also cover the entire foot area as shown in FIG. 1. In the upper plate 22, the roll point 30 of the rocker bottom 28 is disposed behind, and preferably approximately 2.5 cm behind the upper metatarsal heads, but may also be positioned between the toe break and approximately 2.5 cm behind the toe break of the wearer. Preferably, the roll point 30 is disposed approximately 60% forward from the posterior margin of the sole 14.

The roll point 32 of the lower plate 24 is located behind the roll point 30 of the upper plate 22 by a distance $D_1$ which is about 0.5 to about 4 cm, preferably about 2.5 cm. This offset of the roll points between the upper and lower plates allows the upper plate 22 to comfortably cradle the metatarsal while the lower plate 24 has a rocker bottom effect to propel the wearer forward.

The plates 22, 24 are independent plates, meaning the plates 22, 24 are not formed from a single continuous member, such as a C-shaped or O-shaped member, but are independently movable and are interconnected by movable separating elements to allow at least two dimensional motion of the plates with respect to one another. The independent plates are not hinged with respect to one another for one dimensional motion, but are connected together in a manner which allows at least two dimensional motion.

The energy return system 20 further includes at least one separating element 26 disposed between the upper and lower sole plates 22, 24. In the illustrated embodiment, a first separating element **26*a* is provided at the posterior end of the forefoot and a second separating element 26*b* is provided in the heel area of the sole portion 14. The separating elements 26*a*, 26*b* are preferably formed from an elastomeric material. As will be appreciated by one skilled in the art, although any elastomer product could be adapted to provide the separating function and other mechanisms of separation and attachment could be used, the use of an adhesive for attachment is preferred so as not to cause a loss of fiber as would occur with riveting and a polyurethane elastomer can be useful due to its ability to adhere to plates 22, 24** formed of carbon graphite.

The separating elements **26*a*, 26*b*** may be formed from an elastomeric material which displays elastic deformation upon the application of a compressive force. Preferably, the deformation is substantially or completely recoverable when the force is removed.

The recoverable deformation aspect of the materials comprising the separating elements **26*a*, 26*b*** may be achieved by any number of ways, including crosslinking, or through the use of thermoplastic elastomers that do not rely on crosslinking to produce the elastic (recoverable) deformation. Such thermoplastic elastomers include styrene-butadiene block copolymers, olefinic copolymers, urethanes, and polyester block copolymers. The elastomeric material may be a foam.

Examples of suitable elastomers include polyisoprene, polybutadiene, polybutylene, polychloroprene (neoprene), butadiene-styrene, butadiene-acrylonitrile, and polysiloxane (silicone). These materials have tensile strengths ranging from about 500 to 4000 psi, and elongations ranging from about 200 to 2,000 percent. According to one embodiment, the elastomeric separating elements **26*a*, 26*b*** have a tensile strength of about 2000 to about 6000 psi. As will be understood by one skilled in the art, the elastomers may be used by themselves, in combinations with other elastomers, or as the matrix component of a composite structure. The composites may be particulate, fibrous, or layered composite structure.

An exemplary elastomer that may be used as a whole or part of the separating element **26*a*, 26*b* is polyurethane having a tensile strength of about 3500 psi, which advantageously adheres to a graphite fiber reinforced composite material of the upper and lower sole plates 22, 24**.

The separating elements **26*a*, 26*b* are provided primarily for the purpose of maintaining the desired spacing between the upper and lower plates 22, 24 so that independent movement of each of the plates can be obtained. The independent movement of the upper and lower plates 22, 24** allows three dimensional movement in the vertical plane, medial-lateral plane, and tortion. Thus, since shock absorbency is not a specific goal thereof, other materials and even a partially rigid or mechanical separator are also deemed to be within the scope of the present invention.

The shoe sole 14 of the present invention provides a means for advantageously using the progression of forces from impact on the foot to receive and return energy. The rigid plates 22, 24 are strategically spaced from each other and placed along the lines of progression of forces between the ground and the foot. The plates thus provide a source of rebound energy. The rocker bottom configuration of the rigid plates 22, 24 is utilized to enhance the efficiency of an athlete. The shoe sole of the present invention thus enhances the wearer's efficiency through the entire gait. The embodiment of FIGS. 1–3 discussed above is used below as an example of how the energy return system of the shoe sole functions throughout the gait cycle.

Figure 7A:
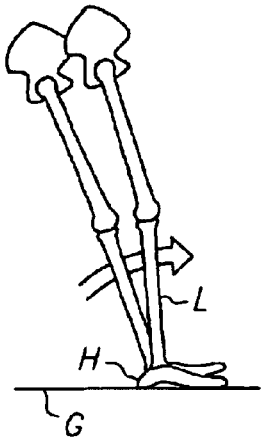
FIGS. 7A–7C schematically illustrate the gait cycle.
Figure 7B:
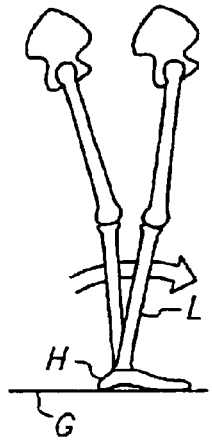
Figure 7C:
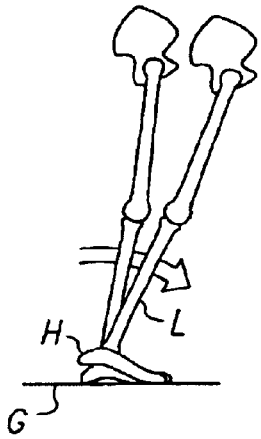

The gait cycle of normal human locomotion includes three main rocker positions, as schematically shown in FIGS. 7A–7C. The first of these position is defined by heel strike, when initial contact is made with the ground surface G by the heel H and thereby provides a heel rocker (FIG. 7A). After initial contact, the body weight of the person is transferred onto the forward limb L and using the heel H as a rocker, the knee is flexed for shock absorption. This stance is called a loading response. During the next phase of the gait cycle, the midstance, the limb L advances over the stationary foot due to ankle dorsiflexion, thereby providing an ankle rocker (FIG. 7B), and the knee and hip extend. Finally, during the terminal stance of the gait cycle, the heel H rises and the limb L advances over the forefoot rocker (FIG. 7C).

Figure 8A:
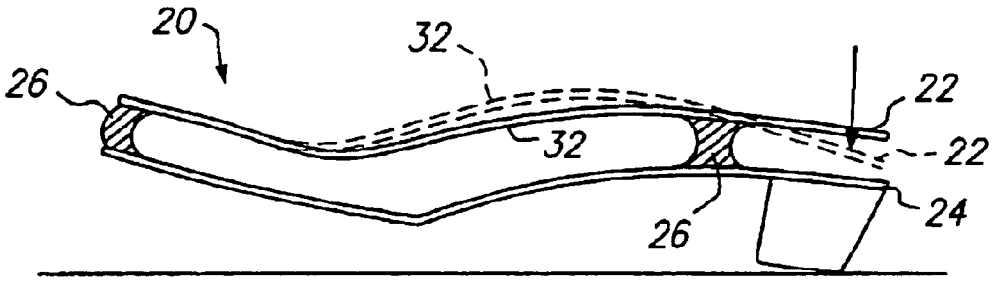
FIGS. 8A–8C schematically illustrate the energy return system of the present invention throughout the gait cycle.

Referring to FIG. 8A, at heel strike (heel rocker) the heel portion of the energy return system 20 flexes in all planes to accommodate heel contact of different people. More particularly, upper plate 22 is deflected vertically downward toward the ground surface (as shown in broken lines), thereby causing the arch portion 32 to be deflected upwards, or preloaded, as shown in broken lines. The bottom plate 24 also assists in absorbing the shock from heel strike through the hydraulic action of the two heel portions of the plates 22, 24 acting through the elastomer separating element 26. That is, the bottom plate 24 at heel strike provides the opposing ground reaction force to the top plate so that by having two plates 22, 24 that deflect in synergy, shock absorption occurs at impact so as to dampen out vibrations encountered during running (or walking). At the heel rocker, the muscles on the front of the leg contract to decelerate the foot drop into a flat foot position. At this point, the leg is leaning backwards in the sagittal plane (see FIG. 7A). The deflected portion of the plates 22, 24, extending approximately from the separating element 26*b* rearward toward the heel, absorb the shock at impact and aid in the leg obtaining a ninety degree position over the heel, i.e., the loading response.

Figure 8B:
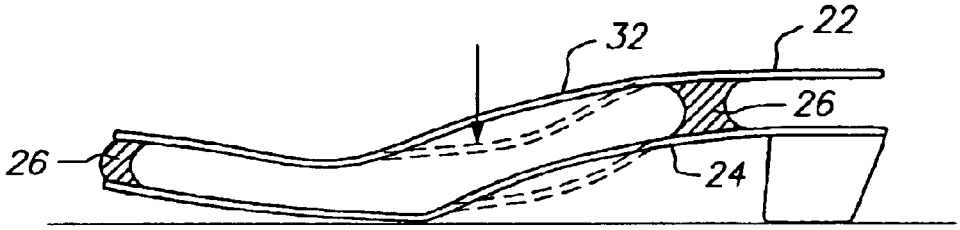

During the loading response, the separating elements 26 provide stability to the foot but also allow for the necessary medial and lateral motion to occur so that uneven terrain can be accommodated as in normal ankle motion. However, since this medial and lateral motion is controlled by the energy return system 20, less ankle motion is required in order to provide the same degree of stability. Just following heel strike, during midstance (ankle rocker), as shown in FIG. 8B, the energy return system 20 is slowly loaded as the limb advances over the stationary foot. The pressure under the metatarsals found during this stage of the cycle is significantly reduced because of the hydraulic action of the two plates under the metatarsals accommodating a significant portion of the pressure. At the ankle rocker point, the foot is flat on the ground and the arch is utilized to store energy. More particularly, energy can be stored approximately between the two separating elements 26*a*, 26*b* by the plates 22, 24 deflecting into an arch.

Figure 8C:
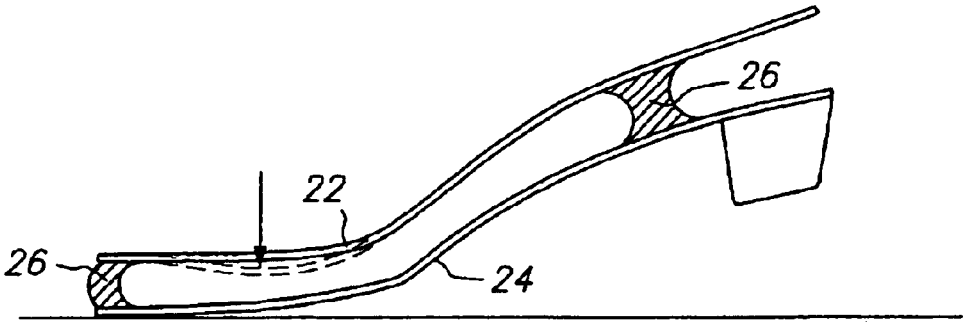

At toe off (forefoot rocker), as shown in FIG. 8C, the toe portion of the upper plate 22 is bent. The upper plate 22 accommodates the foot in slightly plantarflexed position while the lower plate 24 provides a rocker pivot point. The forefoot rocker is where the calf muscles act most vigorously. All the energy stored in the plates 22, 24 up to this point of the gait cycle is getting ready to be released into a step forward and upward. During use, the rigid plates actively fight to resume their pre-existing state and both plates release the energy that had been stored from the arch and the ball of the foot area. Thus, not only does the energy return system 20 of the present invention rock the wearer forward, but it will also move in an upward motion thereby providing optimal energy return. Because the upward momentum is delivered primarily from the forefoot during toe off, the embodiment of the present invention shown in FIGS. 4–6, as discussed in detail below, is particularly useful for sprinters and jumpers, where the heel may never touch the ground.

Figure 9A:
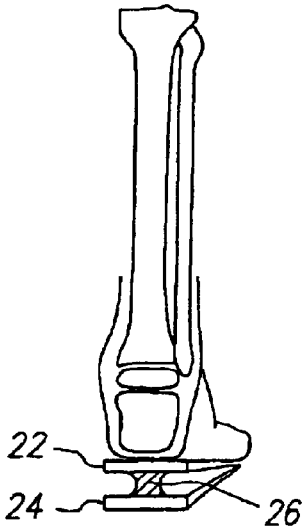
FIGS. 9A–9B schematically illustrate medial and lateral movements occurring during the gait cycle.
Figure 9B:
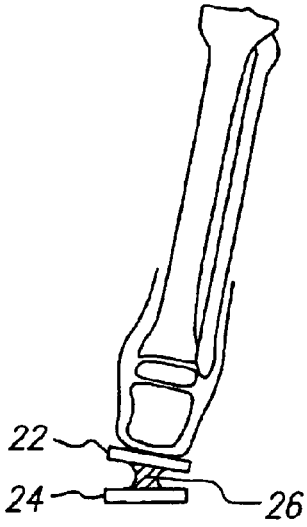

As discussed above, the majority of the force that is provided by the toes in running is provided by the large toe. The additional thrust provided by the small four toes during toe off, although not as large as that provided by the large toe, is still a significant factor in the gait cycle. The energy return system 20 accommodates the thrust provided by the small toes and the average 25° external torsion of the foot and ankle relative to the knee axis during a gait cycle. More specifically, as shown schematically in FIGS. 9A and 9B, the separating elements 26 of present invention are designed to accommodate various angles of the foot which may occur during the gait cycle. At heel strike, the hind foot is into supination (the ankle is turned in). The impact from the ground reaction forces are thus absorbed on the outside of the heel or foot. The plates 22, 24 are still able to absorb the shock because the elastomeric nature of the separating elements allows the plates to deflect in that direction. In contrast, at the forefoot rocker, the forces are shifted from the lateral (outside) of the forefoot to the first metatarsal (big toe area). Due to the presence of the separating elements, the present invention allows the plates to also deflect in this direction and thus return the energy in the most optimal fashion throughout the gait cycle.

The space between the two plates 22, 24 provides a void and allows a range of motion of the plates which covers the entire space between the plates at the areas where maximum plate deformation will occur. For example, the plates in the heel area are able to deflect the entire distance of the gap between the plates due to the location of the separating element 26*b* at the location of the ankle rocker or at the ankle pivot point. Thus, the impact of heel strike is complete by the time the weight is being rotated over the ankle. Similarly, the separating element 26*a* is located at the toe portion of the shoe where most of the foot has already left the ground and kinetic energy has already been returned. Thus, there is a void between the separating elements 26*a*, 26*b* and behind the separating element 26*b* which allow the plates to deform in these areas to a maximum distance of the height of the void.

The space between the two plates 22, 24 may be provided with one or more small bumps or ridges on either of the plates to improve the shoe feel in the case of bottoming out of the plates. These small bumps or ridges can be resilient elements having a height of about 1 mm to a few millimeters.

Figure 4:
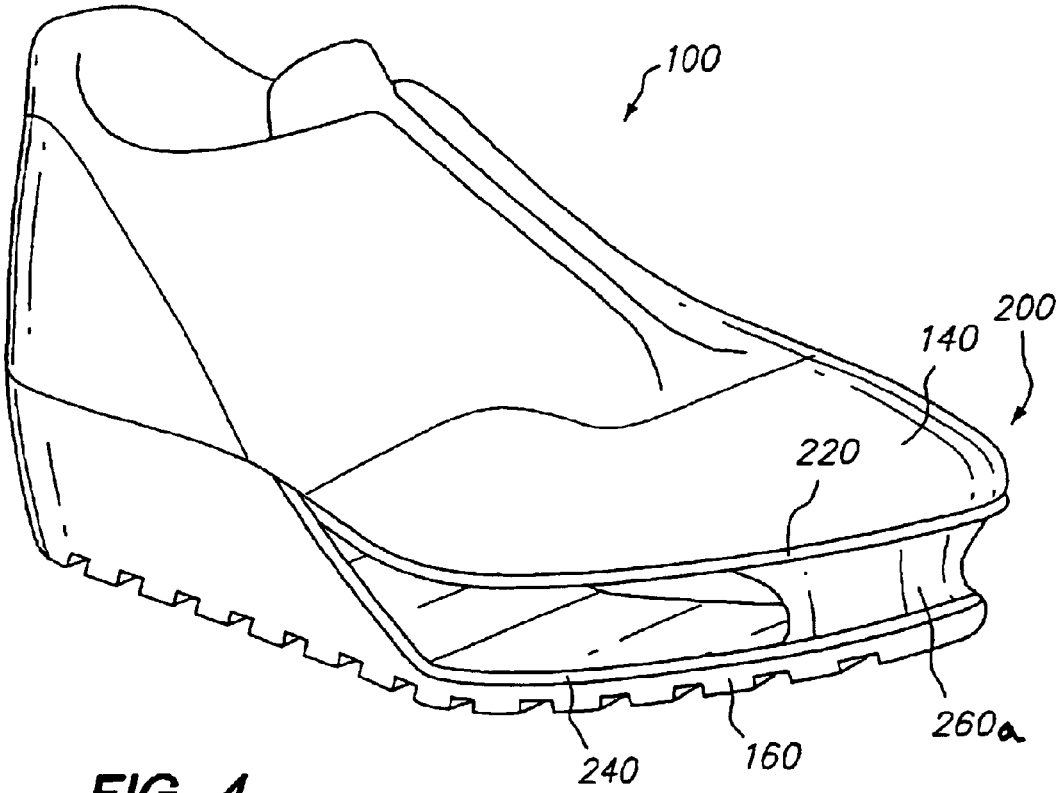
FIG. 4 is a perspective view of a shoe including a further embodiment of the energy return system of the present invention.
Figure 5:
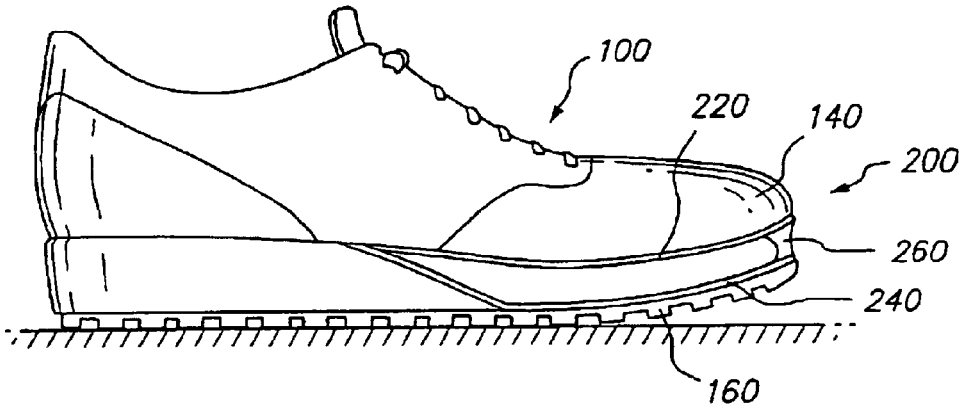
FIG. 5 is a lateral view thereof.
Figure 6A:
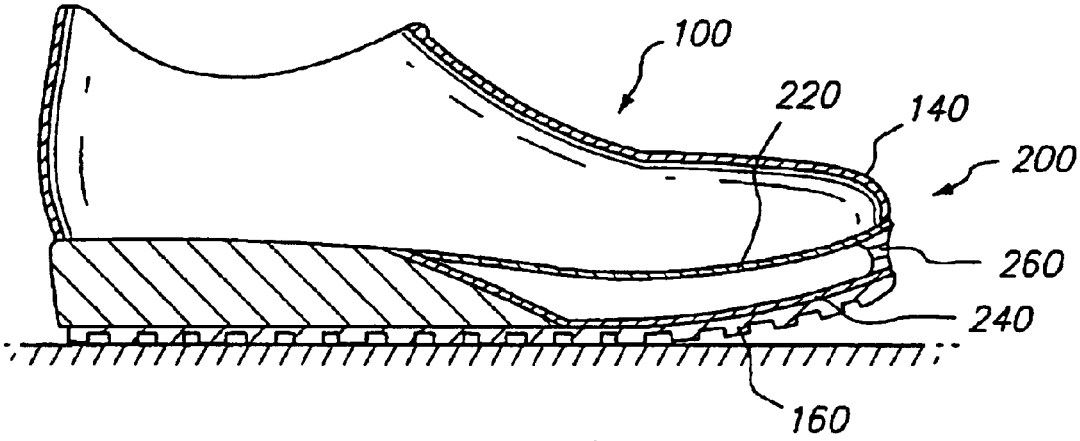
FIG. 6A is a cross-sectional view thereof.
Figure 6B:
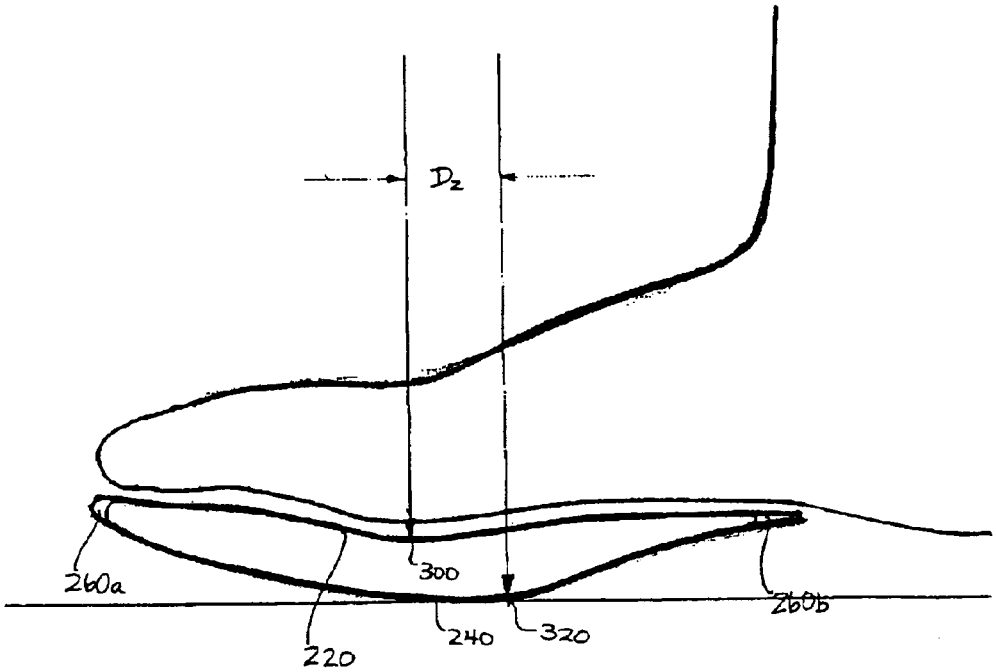
FIG. 6B is a cross-sectional side view of a portion of FIG. 6A shown schematically supporting a foot.

Referring to the further embodiment shown in FIGS. 4–6, shoe 100 includes an energy return system 200 preferably disposed between the outsole 160 and the upper portion 140 and extends only a portion of the length of the shoe. As in the above-described embodiment of FIGS. 1–3, the energy return system 200 includes upper and lower sole plates 220, 240 made of rigid material, such as fiber reinforced polymers. The upper and lower plates 220, 240 can be formed in accordance with the teaching of U.S. Pat. No. 4,858,338 (Schmid), wherein crossed fibers of a straight graphite strip and an angled graphite strip are used to cradle the first metatarsal head of the foot, provide maximum stiffness to resist torsion in both directions and activate the rocker bottom system, as discussed below. The energy return system 200 further includes at least one separating element 260 disposed between the upper and lower sole plates 220, 240. In the illustrated embodiment, a first separating element 260*a* is provided in the toe area of the sole portion 140 and a second separating element 260*b* is provided in the arch area of the sole. The separating elements 260 can be formed from a polyurethane elastomer, although other materials could also be used as discussed above. The separating elements 260 are provided for the purpose of maintaining the desired spacing between the upper and lower plates 220, 240 so that independent movement of each of the plates can be obtained. The height of the separating element 260*b* can be small as long as independent movement of the plates in multiple dimensions is maintained.

The roll point 320 of the lower plate 240 is located behind the roll point 300 of the upper plate 220 by a distance $D_2$ which is about 0.5 to about 4 cm, preferably about 2.5 cm. This offset of the roll points 300, 320 between the upper and lower plates allows the upper plate 220 to comfortably cradle the metatarsal while the lower plate 240 has a rocker bottom effect to propel the wearer forward.

In the embodiment of FIGS. 4–6 the plates 220, 240 flex toward each other upon loading. The lower plate 240 has a single point of contact with the ground during the gait cycle, when viewed from the side, resulting in deflection of the lower plate toward the upper plate 220. The deflection of the two plates toward one another and release of stored energy from the two plates on toe off results in twice the energy return.

Since the system of the present invention permits but dampens distortion and actively pursues return to the resting state, injuries such as ankle sprain, shin splints, or other nagging problems may be minimized. The shoe sole system of the present invention not only accommodates but innovatively enhances the performance of athletes who use athletic footwear as an important component of their sporting endeavor.

Therefore, the present invention provides a shoe sole having an energy return system which may be particularly useful in athletic shoes. The shoe sole may be useful in activities such as walking jogging, sprinting, aerobics, distance running, high jumping, poll volting, bicycling, and tennis. The number of graphite layers employed is selected to accommodate the weight and size of different users. Thus, the shoe sole may be used by persons of virtually all ages and body types.

The stiffness and performance of the shoe may be varied or tuned for different users and/or uses in a variety of manners. According to one embodiment, the stiffness can be tuned by varying the material of the elastomer in the separating elements. The performance including the energy returned can be varied by varying the material of the plates. Plugs of stiffer material may be added to the elastomer to vary the stiffness without the need to change the configuration of the upper and lower plates.

The following examples emulate exemplary of the types of modifications which may be made to adapt the shoe for different uses. According to one embodiment, a walking shoe, medical shoe, or diabetic shoe may include upper and lower plates 22, 24 of fiberglass which allows manufacture at a lower cost than graphite, achieves the desired cushioning effect, and still provides substantial energy return.

According to another embodiment, a basketball shoe may have a rounded bottom plate for improved move maneuverability. A basketball shoe may also employ a negative heel. The negative heel includes a sole configuration in which the heel is positioned lower than the ball of the foot. The negative heel greatly increases stability and improves jumping ability by elongating the Achilles tendon.

In another embodiment, the shoe of FIGS. 4–6 may be designed as a sprinter's shoe for high performance athletes. The sprinter's shoe would include high performance materials while a similar shoe designed for more recreational running would use a similar configuration with less costly materials.

Figure 10:
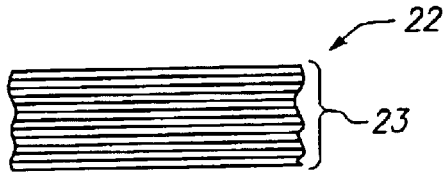
FIG. 10 illustrates an enlarged cross-sectional view of a portion of one of the plates.
Figure 11:
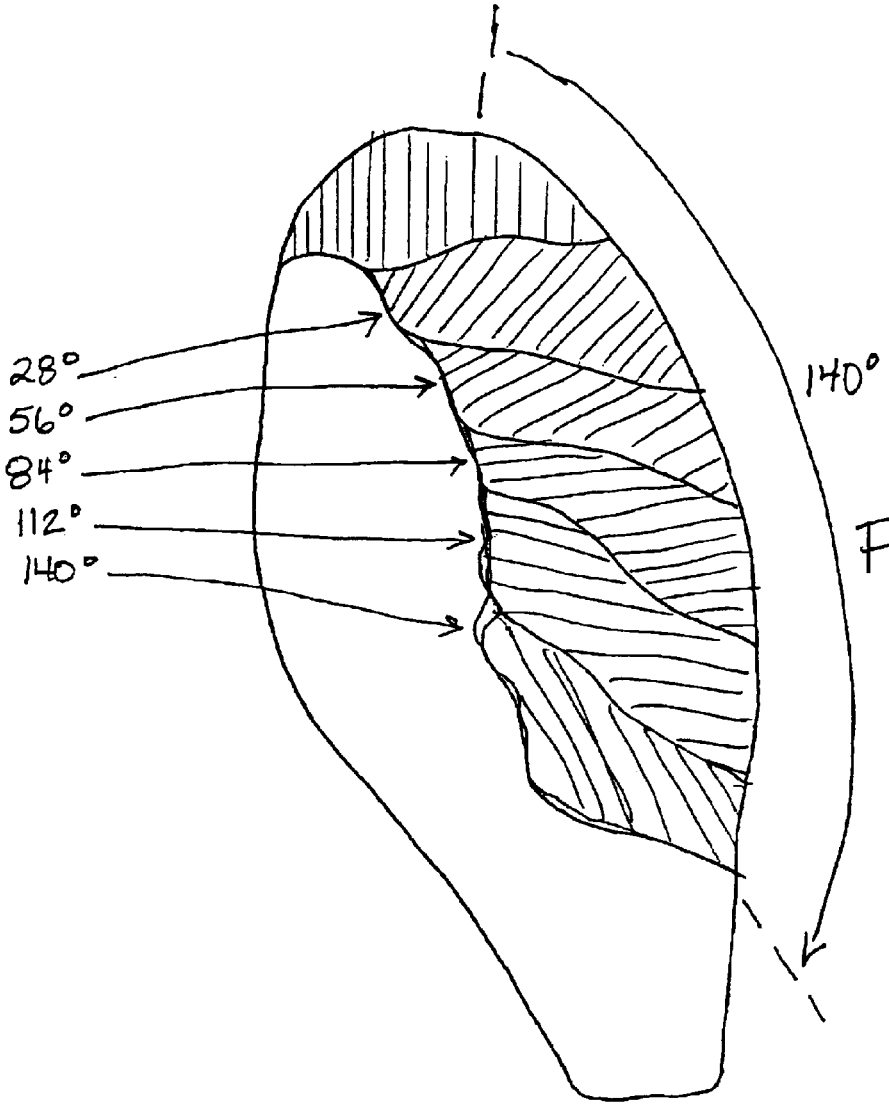
FIG. 11 is a schematic top view of one of the plates which has been partially cut away to illustrate the fiber direction.

FIGS. 10 and 11 illustrate one example of a plate 22, 24 for use in the present invention. As shown in FIG. 10, the plate is formed of a plurality of layers 23, such as graphite fiber layers. As shown in FIG. 11, each layer may be provided with a slightly different fiber orientation. The different fiber orientations of the different layers, cover a range of angles which go from parallel to the line of progression to about 140° lateral of the line of progression. This range of fiber angles accommodates any of the stresses which may be placed on the plate by the wearer throughout the wearer's stride. Alternatively, the fibers may be orientated at angles varying along the full 180° of the sole. The use of layers with fibers oriented in different directions allows the plate to be specifically tuned with more or less fibers in a particular direction to provide strength in directions in which the most forces will be applied to the plate. In this way, the best use may be made of the material.

Further, the energy return system of the present invention also has applications outside of footwear where it is desirable to relieve pressure from particular areas of the body which are subjected to continual contact or impact, such as, for example, the seat of a wheel chair, hospital beds, etc.

The foregoing description of the preferred embodiments of the present invention has been presented for purposes of illustration and description. It is neither intended to be exhaustive or to limit the invention to the precise forms disclosed. Obviously many modifications and variations are possible in light of the above-teachings. It is therefore intended that the scope of the invention be defined by the following claims, including all equivalents.

What is claimed is:

1. An article of footwear comprising:

a first energy return plate extending from a toe area of the foot and terminating at an arch area of the foot;

a second energy return plate independent from the first plate and spaced a predetermined distance from the first plate, the second energy return plate extending from the toe area of the foot and terminating at the arch area of the foot;

a first elastomeric separating element connecting the first and second plates forward of an area of the footwear corresponding to the ball of the foot;

a second elastomeric separating element connecting the first and second plates behind the area corresponding to the ball of the foot and forward of an area corresponding to the heel to maintain the spacing between said plates during a gait cycle of a wearer comprising a toe strike and a toe off the first and second elastomeric elements forming a void between the first and second plates and wherein;

during toe strike the toe portion of both the first and second plates deforms upward; and during toe off the first and second plates recover to the non-deformed state releasing stored energy into a step forward and upward propelling the wearer forward.

2. The article of footwear of claim 1, wherein said first and second plates comprise a material having a modulus of elasticity of at least approximately $10\times10^6$ lb/in$^2$.

3. The article of footwear of claim 1, wherein said elastomeric separating elements comprise a material having a tensile strength at least 2000 psi.

4. The article of footwear of claim 1, further comprising a hollow space without separating elements between the first and second plates in the area corresponding to the ball of the foot.

5. The article of footwear of claim 1, wherein said first one of said separating elements is generally arcuate.

6. The article of footwear of claim 1, wherein the separating elements allow the first and second plates to move with respect to one another in a medial lateral direction.

7. The article of footwear of claim 1, wherein the separating elements allow the first and second plates to rotate with respect to one another in a torsional direction.

8. The article of footwear of claim 1, wherein the void between the first and second plate allows the plates to deform to a height of the void.

9. An article of footwear comprising:

an upper;

a sole having a ground engaging portion and an energy return system between the upper and the sole;

the energy return system comprising:

an upper plate and a lower plate spaced a predetermined distance from each plate, the plates having arch and toe portions and terminating at the arch area of the foot, respectively, the upper and lower plates made from an elastic material of high tensile strength, the plates independently deformable and recoverable from arch portion to toe portion; and two elastomeric elements, one disposed between the toe portion of the plates and the other disposed between the arch portion of the plates to maintain the spacing between said plates during a gait cycle of a wearer comprising a toe strike and a toe off the first and second elastomeric elements forming a void between the upper and lower plates and wherein;

during toe strike the toe portion of both the upper and lower plates deforms upward; and during toe off, the upper and lower plates recover to the non-deformed state releasing stored energy into a step forward and upward propelling the wearer forward.

10. The article of footwear of claim 9, wherein the upper plate has a lateral side and a medial, and wherein during toe off the deformation of the toe portion of the upper plate shifts from the lateral side to the medial side.

11. The article of footwear of claim 9, wherein one of the two elastomeric elements is positioned at a posterior end of the upper and lower plates.

12. The article of footwear of claim 9, wherein said upper and lower plates comprise a material having a modulus of elasticity of at least approximately $32\times10^6$ lb/in$^2$.

13. The article of footwear of claim 12, wherein said material comprises carbon graphite.

14. The article of footwear of claim 13, wherein said upper plate and lower plates are formed by a plurality of layers of carbon graphite.

15. The article of footwear of claim 9, wherein said first one of said separating elements is generally arcuate.

16. The article of footwear of claim 9, wherein one of the separating elements is located entirely forward of a ball of a wearer's foot.

17. The article of footwear of claim 9, wherein the toe portion of the upper plate deflects downward before the upper and lower plates return to the non-deformed state.

18. The article of footwear of claim 9, wherein the void between the upper and lower plates allow the plates to deform to a height of the void.

* * * * *